US009062882B2

(12) United States Patent
Hangauer et al.

(10) Patent No.: US 9,062,882 B2
(45) Date of Patent: Jun. 23, 2015

(54) BURNER SYSTEM

(75) Inventors: Wilfried Hangauer, Rastatt (DE); Rainer Lochschmied, Rheinstetten-Forchhelm (DE); Volker Schmid, Iffezheim (DE)

(73) Assignee: Siemens Aktiengesellschaft, Munich (DE)

( * ) Notice: Subject to any disclaimer, the term of this patent is extended or adjusted under 35 U.S.C. 154(b) by 743 days.

(21) Appl. No.: 13/412,255

(22) Filed: Mar. 5, 2012

(65) Prior Publication Data

US 2012/0276487 A1 Nov. 1, 2012

(30) Foreign Application Priority Data

Mar. 3, 2011 (EP) ..... 11156892

(51) Int. Cl.
*F23N 1/02* (2006.01)
*F23N 5/12* (2006.01)

(52) U.S. Cl.
CPC . *F23N 5/123* (2013.01); *F23N 5/12* (2013.01); *F23N 2025/30* (2013.01)

(58) Field of Classification Search
CPC ..... F23N 1/02; F23N 5/12
USPC ..... 431/75, 258, 25, 159, 264; 236/1 R, 46; 219/494, 121.81; 126/39 BA
See application file for complete search history.

(56) References Cited

U.S. PATENT DOCUMENTS 4,447,204 A * 5/1984 Isenberg ..... 431/76
5,003,960 A * 4/1991 Hanagan ..... 126/39 BA
5,472,337 A * 12/1995 Guerra ..... 431/78
6,280,180 B1 * 8/2001 Fredin-Garcia-Jurado et al. ..... 431/27
7,435,082 B2 * 10/2008 Jayne ..... 431/264
8,177,546 B2 * 5/2012 Jayne ..... 431/264
2011/0018544 A1 * 1/2011 Bertelli ..... 324/459
2014/0170575 A1 * 6/2014 Krichtafovitch ..... 431/253

(Continued)

FOREIGN PATENT DOCUMENTS

DE 44 33 425 A1 3/1996
DE 196 32 983 A1 2/1998

(Continued)

OTHER PUBLICATIONS

Office Action issued Jul. 29, 2013 in corresponding Japanese Application No. 2012-047891.

*Primary Examiner* — Gregory Huson
*Assistant Examiner* — Nikhil Mashruwala
(74) *Attorney, Agent, or Firm* — Staas & Halsey LLP

(57) ABSTRACT

A grounded burner, actuators adjusting the supply of fuel and air to the burner, an ionization electrode in the flame region, a flame amplifier at the ionization electrode generating an ionization signal, and a final control device are included in a burner system. During air ratio control mode, the final control device sets a first actuator and adjusts a second actuator. During voltage control mode a voltage regulator controls the AC voltage source using the AC voltage measured by the voltmeter, in conjunction with an ionization current amplifier. The voltmeter is connected in parallel with a sequence of the ionization electrode, the flame region, the burner and the input of the ionization current amplifier. The voltage regulator is connected to the voltmeter such that, during voltage control mode, the time-averaged current caused by the voltmeter through the connection is less than 5% of the time-averaged current through the ionization electrode.

16 Claims, 2 Drawing Sheets

(56) References Cited

U.S. PATENT DOCUMENTS

| | | | | |
|---|---|---|---|---|
| 2014/0212820 | A1* | 7/2014 | Colannino et al. | 431/2 |
| 2014/0227645 | A1* | 8/2014 | Krichtafovitch et al. | 431/2 |

FOREIGN PATENT DOCUMENTS

| | | | | |
|---|---|---|---|---|
| DE | 100 21 399 | A1 | 12/2001 | |
| EP | 0 908 679 | A1 | 10/1997 | |
| EP | 908679 | * | 10/1997 | G08B 17/12 |
| EP | 1 160 982 | A1 | 4/2001 | |
| EP | 1 460 338 | A1 | 3/2004 | |
| EP | 2 154 430 | A1 | 8/2008 | |
| JP | 58-53765 | | 3/1983 | |
| JP | 59-131826 | | 7/1984 | |
| JP | 60-71822 | | 4/1985 | |
| JP | 2-50022 | | 2/1990 | |
| JP | 7-260138 | | 10/1995 | |
| JP | 2005-16765 | | 1/2005 | |
| WO | 2009/110015 | A1 | 9/2009 | |

* cited by examiner

BURNER SYSTEM

CROSS REFERENCE TO RELATED APPLICATIONS

This application is based on and hereby claims priority to European Application No. 11156892 filed on Mar. 3, 2011, the contents of which are hereby incorporated by reference.

BACKGROUND

In order to be able to correct external factors affecting combustion quality, such as variations in fuel quality, temperature or pressure fluctuations, the ratio of air to fuel, the so-called air ratio or lambda λ, must be adjusted. A corresponding setup is also known as a fuel/air interconnection. A particularly inexpensive sensor for measuring lambda is the ionization electrode. When an AC voltage is applied, there flows through the electrode and flame an ionization current which is adjusted to a setpoint value specified as a function of the respective output of the burner. Using such an arrangement, the air ratio can be controlled, as the ionization current is a function of the air ratio at the respective output level. The AC voltage is adjusted to a voltage setpoint by a voltage regulator.

A signal processing arrangement for a burner system of the type mentioned in the introduction is indicated in DE-C2-19632983. This publication mentions a fuel/air connection having a signal detection circuit according to DE-A1-4433425 wherein an additional compensation circuit for the AC voltage applied to the ionization electrode is apparently required. This AC voltage must always be kept at a constant magnitude, or measured and mathematically compensated. Generating an AC voltage of constant magnitude is the to be complex in terms of circuitry and, even when using the control circuit as a microprocessor-based digital circuit, additionally requires digitization of the initially analog signal in order to be able to process it further. This is why a different solution is proposed in DE-C2-19632983.

An AC voltage regulator with adjustment to a constant RMS value is known, for example, from DE-A1-10021399. The AC voltage is adjusted by controlled phase angle control which is implemented in the form of a closed loop.

EP-A1-2154430 discloses a flame amplifier for detecting the ionization current using an ionization electrode which is disposed in the flame region of a gas burner and is connected to an AC voltage supplied by a secondary circuit of a transformer. The secondary circuit is electrically isolated from the primary circuit. In the secondary circuit, an ionization current having a DC component caused by the flame flows to an amplifier. The direct current flows through the AC voltage source to the ionization electrode and forms a closed loop with the flame. The signal processing circuit delivers a controlled variable dependent on the ionization current to a control device which compares this actual value with a setpoint value. Depending on the result, the control device generates the actuating signals for the final control elements, e.g. for a blower for adjusting the quantity of air and for a gas valve for adjusting the quantity of gas for combustion. There is no suggestion of correcting the AC voltage present at the ionization electrode as a result of line faults. Nor is attention drawn to the fact that many components, in particular the transformer, have significant tolerances and therefore systematic measurement errors occur, resulting in systematic variance in the adjusted λ-value.

WO-A1-2009/110015 discloses a method for monitoring a flame whereby parasitic elements occurring during operation can be detected and compensated. For this purpose an AC voltage source is controlled on the basis of the ionization current measured such that an AC voltage signal with markedly different duty ratio between positive and negative amplitude is generated with different amplitude values and is applied to the ionization electrode. WO-A1-2009/110015 also discloses that high AC voltages at the ionization electrode and flame and therefore also high amplitudes of the AC voltage source produce a lower dependence of the ionization signal on layers which can form on the burner and ionization electrode. Because of the nonlinear behavior of the flame, linear compensation as proposed in DE-C2-19632983 is inappropriate at the high AC voltages aimed for. The AC voltage applied must be sufficiently precise in order to eliminate systematic errors due to component variations.

SUMMARY

Described below is closed-loop control of AC voltage to a predefinable voltage setpoint with which the AC voltage used to measure an ionization current for fuel/air interconnection control can be kept sufficiently constant in an inexpensive, simple and reliable manner.

A voltmeter is connected in parallel with a series circuit including the ionization electrode, the flame region, the burner and the input of an ionization current amplifier, in that order. The input of the ionization current amplifier is connected to a terminal connection to burner ground. This permits an ionization current amplifier power source that is shared by other active circuit components. The other terminal is virtually connected to burner ground potential by the ionization current amplifier and is connected to the AC voltage source.

In an alternative sequence, wherein the input of the ionization current amplifier is connected to a terminal connection to the ionization electrode, a special supply for the ionization current amplifier would be necessary, because it is advantageous that active circuit components such as the final control device and the actuators are likewise grounded along with the burner. The same possibly applies in the case of an indirect connection of the ionization amplifier to the burner via a limiting resistor.

DE-A1-4433425 describes an, at first glance, attractive alternative, namely connecting the ionization current amplifier in parallel with the circuit section including the ionization electrode, the flame region and the burner. As described there, a terminal connection from the input of the ionization amplifier and likewise the connection to the AC voltage source can be connected to burner ground without any problem. Burner ground can likewise be easily selected as the reference potential for other active blocks of the voltage control loop, which means that a common power source could be used for all. However, such an arrangement reduces the voltage across the ionization electrode as a function of the ionization current due to the presence of a precision resistor connected in parallel with the flame. With the circuit arrangement described herein, on the other hand, the maximum possible stable voltage is dropped across the ionization electrode, which has an advantageous effect particularly in the case of high flame resistances or else in the case of coatings on the burner and ionization electrode.

The voltage regulator is connected to the voltmeter. The voltage regulator also receives a setpoint signal and its output is connected to the AC voltage source, the amplitude of the AC voltage being defined by the output signal of the voltage regulator. It is greatly advantageous if the setpoint signal, the voltage regulator and the input of the AC voltage source can also be connected to ground as reference potential so that no separate supply is necessary. A connection of the voltmeter to the voltage regulator results in a parasitic current from the voltage regulator via ground through the input of the ionization amplifier; however, this parasitic current has little effect on air ratio control if its averaged value is less than 5% of the averaged value of the ionization current through the flame; this does not make the flame amplifier significantly more expensive, nor does it impair its effect. In practice, in the stable, adjusted state of the air ratio, such a ratio of the parasitic current to the ionization current of less than 0.1% is achievable.

As a result of the measures described above, the control loop for air ratio control by the ionization signal setpoint and the control loop for voltage control are very well decoupled so that the two control processes do not affect one another.

The circuit for measuring the AC voltage applied can be very precisely implemented. Variations and temperature sensitivities of components of the AC voltage source can therefore be corrected via voltage control.

In an embodiment, the sequence preceding the ionization electrode or following the input of the ionization current amplifier additionally incorporates a limiting resistor, and the voltmeter is equipped with a series of resistors and with a measuring unit which, during voltage control mode, taps off the voltage between two of the resistors. The effective resistance of the measuring unit of the voltmeter and the effective resistance of the voltage regulator at its input to the voltmeter are in total at least 10 times greater than the limiting resistor. The parasitic current can thus be simply and reliably kept below the permissible limit value. The measuring unit of the voltmeter may include a rectifier in the series of resistors, and provides smoothing of the voltage tapped off between the resistors.

In an embodiment, the AC voltage source is equipped with a voltage generator and with a multiplier which multiplies the output voltage of the voltage generator by the signal at the output of the voltage regulator. The voltage generator produces a voltage signal, the amplitude and frequency of which is independent of the AC line. This reduces the reaction time requirement on the voltage control circuit, because the air ratio control is not subject to rapid line voltage fluctuations. The AC voltage source is advantageously equipped with a transformer which is connected on the output side in parallel with the sequence of the ionization electrode, flame region, burner and ionization current amplifier. This provides a simple way of connecting the terminal connection connected to the AC voltage source at the input of the ionization current amplifier virtually and not directly to burner ground potential.

BRIEF DESCRIPTION OF THE DRAWINGS

Various exemplary embodiments will now be described with reference to the accompanying drawings in which.

DETAILED DESCRIPTION OF THE PREFERRED EMBODIMENT

Figure 1:
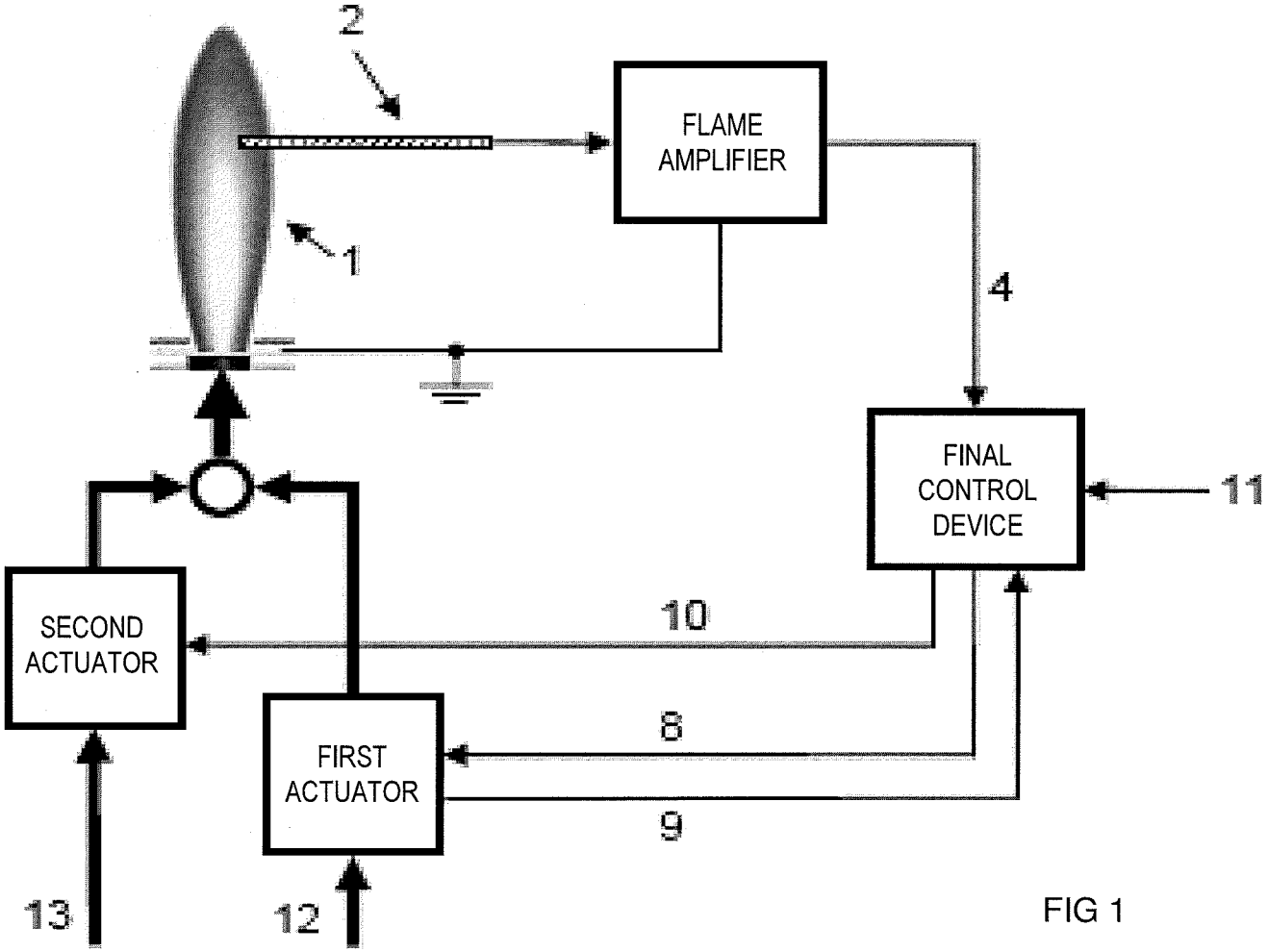
FIG. 1 is a block diagram schematically illustrating a burner system in which the air ratio is controlled via an ionization signal.

Reference will now be made in detail to the preferred embodiments, examples of which are illustrated in the accompanying drawings, wherein like reference numerals refer to like elements throughout.

FIG. 1 schematically illustrates a burner system with fuel/air interconnection control. An ionization current through a flame 1 produced by the burner is detected by a flame amplifier 3 via an ionization electrode 2. The circuit is completed by the connection of the flame amplifier 3 to burner ground. The ionization signal 4 processed by the flame amplifier 3 is forwarded to a final control device 5 which during normal operation uses the ionization signal 4 as the input signal for a control loop. The ionization signal 4 is implemented as an analog electrical signal, but can alternatively be a digital signal or variable of two software module units.

The final control device 5 receives an external demand signal 11 with which the heat output is specified. The control circuit can also be switched on and off with the demand signal 11. For example, a heat request is generated by a higher-order temperature control circuit not shown here. Such an output requirement can of course also be generated by another external load or else also directly specified manually, e.g. via a potentiometer.

As usual, the demand signal 11 is mapped using data stored in the final control device 5 to one of the two actuators 6, 7. The demand signal 11 may be mapped to speed setpoints for a blower as the first actuator 6. The speed setpoints are compared with a speed signal 9 fed back by a blower 6. Using a speed controller incorporated in the final control device 5, the blower 6 is adjusted via a first actuating signal 8 to the required delivery rate of air 12 for the specified demand signal 11. Alternatively, the demand signal 11 can of course be mapped directly to the first actuating signal 8 of the blower 6. Conversely, it is also possible for the demand signal 11 to be mapped to a fuel valve as the first power-carrying actuator 6.

Using the second actuator 7, such as a fuel valve, the air ratio is corrected via the supply of fuel 13. This is done by mapping the specified demand signal 11 via a function to an ionization signal setpoint in the final control device 5. The ionization signal setpoint is compared with the ionization signal 4. Using the error signal, the air-ratio-correcting fuel valve 7 is controlled via a control unit implemented in the final control device 5. A change in the ionization signal 4 therefore produces, via a second actuating signal 10, a change in the fuel valve setting 7 and therefore in the flow rate of the quantity of fuel 13. The control loop is completed in that, for the specified quantity of air, a change in the quantity of fuel produces a change in the ionization current through the flame 1 and ionization electrode 2 and therefore also a change in the ionization signal 4, until its actual value is again equal to the specified ionization signal setpoint.

Figure 2:
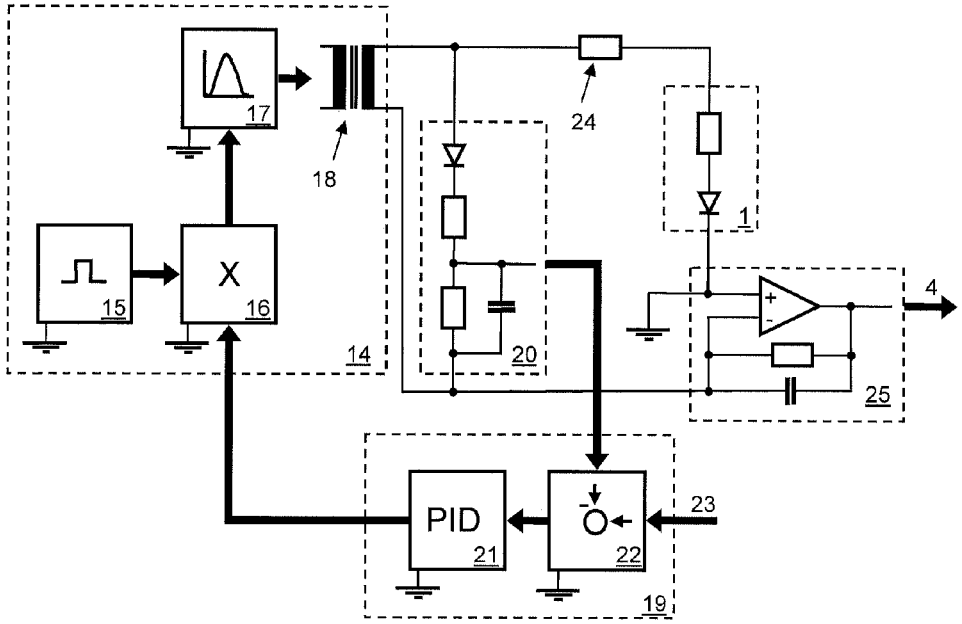
FIG. 2 is a block diagram of a first flame amplifier.

FIG. 2 is a block diagram showing the layout and operation of a first flame amplifier. An AC voltage source 14 includes a voltage generator 15, a multiplier 16, a filter 17 with an optionally integrated amplifier, and a transformer 18. During voltage control operation, the voltage generator 15 produces a square wave voltage signal which is applied to an input of the multiplier 16. Present at the other input of the multiplier 16 is a signal which is provided by a voltage regulator 19 and with which the amplitude of the square wave signal produced by the multiplier 16 can be adjusted.

The multiplier 16 can be of a simple design; for example, an inverter stage having a switching transistor and a resistor, the supply level and the output level and therefore the amplitude of the square wave signal obtained at the output of the multiplier 16 being determined by the voltage regulator 19. The amplitude-modulated square wave voltage signal of the multiplier 16 is fed to the filter 17 which converts it into a sinusoidal AC voltage signal which can be further amplified in an analog manner if required. Alternatively, an AC voltage with a different signal shape can also be generated, the amplitude being determined by the voltage regulator 19.

The transformer 18 transfers the AC voltage signal obtained from the filter 17 on the primary side to the secondary side which is electrically isolated from the primary side. The transformation ratio of the transformer may be selected such that the amplitude of the AC voltage obtained on the secondary side of the transformer is much greater than the amplitude of the AC voltage on the primary side, thereby enabling the desired high signal level of the AC voltage to be provided. If the signal level at the output of the filter 17 is sufficient, the transformer 18 can alternatively be dispensed with and the ionization circuit supplied in another way from the output of the filter 17, provided it remains decoupled from burner ground.

The AC voltage obtained by the transformer 18 on the secondary side is measured by a voltmeter 20 in which it is advantageously rectified and smoothed. In the embodiment presented here, the voltmeter 20 includes a voltage divider, a diode and a capacitor. The diode performs half-wave rectification in which the voltage divider and capacitor act as a lowpass filter which smoothes the rectified signal. The diode and capacitor therefore constitute a measuring unit. The output signal for the voltmeter 20 is directly tapped off at the capacitor. The output signal is a DC voltage signal which, via the rectification factor, is proportional to the amplitude of the AC voltage at the output of the transformer 18.

The DC voltage signal generated by the voltmeter 20 is present as an actual value at the input of the voltage regulator 19. In this exemplary embodiment, the voltage regulator 19 contains a PID controller 21 as well as a comparator 22 as an input stage which compares the actual value with a voltage setpoint 23. The comparator 22 generates a deviation-dependent analog signal which is applied to the input of the PID controller 21. Its input impedance is greater than 10 MΩ. The PID controller 21 in turn generates a signal which is fed to the input of the multiplier 16, thereby providing a closed voltage control loop with which the detected actual value can be precisely adjusted to the voltage setpoint 23.

In a variant, voltage control is not only maintained during air ratio control, but also during times in which no air ratio control is taking place, such as during the flame ignition process, or also during the air ratio control calibration process. In another variant, voltage control only takes place for a short period during commissioning of the system in order to eliminate the effect of component tolerances. The AC voltage source 14 is in any case immune to line voltage fluctuations. Voltage adjustment is repeated at regular intervals for the purpose of calibration.

Connected in parallel with the voltmeter 20 is a series circuit including a 600 kΩ limiting resistor 24, the ionization electrode 2, the flame 1 and the input of the ionization current amplifier 25 with two terminal connections. This series circuit constitutes a measuring path for sensing the ionization current. The flame 1 is shown in FIG. 2 in the form of an electrical equivalent circuit diagram which contains a flame resistor and a flame diode.

The ionization current first flows through the limiting resistor 24, through the ionization electrode 2 not shown in FIG. 2, through the flame 1, through the burner and through the input of the ionization current amplifier 25. The limiting resistor 24 limits the ionization current which is amplified by the ionization current amplifier 25 in a virtually non-interacting manner. The input of the ionization current amplifier 25 is connected to the burner at one terminal connection. The other input terminal is connected to the transformer 18, it being adjusted virtually to ground potential by the ionization amplifier. This circuit is completed via the transformer 18. Present at the output of the ionization current amplifier 25 is an averaged ionization signal 4 which is analyzed by the final control device 5.

Figure 3:
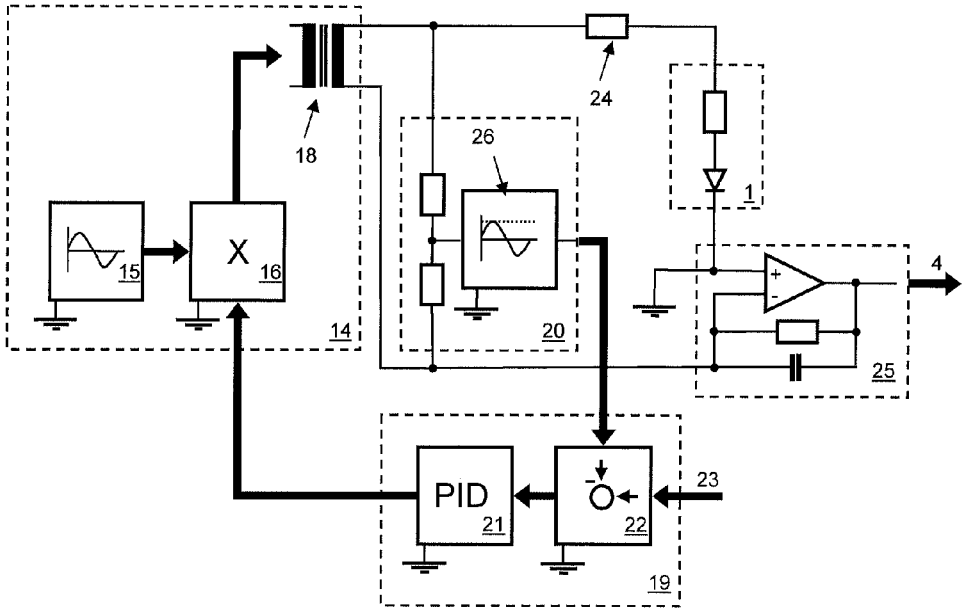
FIG. 3 is a block diagram of a second flame amplifier.

FIG. 3 is a block diagram showing the layout and operation of another flame amplifier. In contrast to FIG. 2, the voltage generator 15 produces a sinusoidal AC voltage signal, thereby obviating the need for the filter 17 shown in FIG. 2. The AC voltage source 14 for producing an AC voltage for the ionization electrode 2 includes a voltage generator 15, multiplier 16 and transformer 18.

In this exemplary embodiment, the peak value of the AC voltage is detected instead of the rectification current. For this purpose the voltmeter 20 has a voltage divider with a peak filter 26 as its measuring unit. In another alternative, the RMS value of the AC voltage can of course be measured. With values greater than 10 MΩ, the peak filter can be of such high-impedance design at its input that the parasitic ionization current through the ionization current amplifier is sufficiently small.

In FIGS. 2 and 3, the voltmeter 20 is conductively coupled to the voltage regulator 19, the input of the voltage regulator being of high-impedance design. It is of course also possible for the connection of the voltmeter 20 to the voltage regulator 19 to be electrically isolated, e.g. by optical data transmission, wherein a parasitic current through the ionization amplifier no longer occurs.

The active components of the AC voltage source 14, of the voltmeter 20 and of the voltage regulator 19, namely the voltage generator 15, the multiplier 16, the filter 17, the peak filter 26, the comparator 22 and the PID controller 21, are for practical reasons connected to ground as reference potential, particularly in order to use a common power source with other circuit blocks.

The block diagram shown in FIGS. 2 and 3 can be implemented, for example, in the form of an analog circuit with passive and active components. In particular, the voltage generator 15, the multiplier 16, the filter 17, the comparator 22, filters in the voltmeter 20 and the PID controller 21 can alternatively be implemented as a program sequence within a microprocessor, the other blocks then being realized as an analog circuit.

A description has been provided with particular reference to preferred embodiments thereof and examples, but it will be understood that variations and modifications can be effected within the spirit and scope of the claims which may include the phrase "at least one of A, B and C" as an alternative expression that means one or more of A, B and C may be used, contrary to the holding in *Superguide* v. *DIRECTV,* 358 F3d 870, 69 USPQ2d 1865 (Fed. Cir. 2004).

What is claimed is:

1. A burner system, comprising:

a grounded burner;

first and second actuators with which the supply of fuel and air to the grounded burner is adjusted;

an ionization electrode disposed in the flame region;

a final control device which during air ratio control mode sets the first actuator and adjusts the second actuator using an ionization signal and an ionization signal setpoint; and a flame amplifier at the ionization electrode, generating the ionization signal and including an AC voltage source generating an AC voltage for the ionization electrode, a voltmeter measuring the AC voltage;

a voltage regulator having a connection to the voltmeter and during a voltage control mode controlling the AC voltage source based on the AC voltage measured by the voltmeter and a voltage setpoint, where during the voltage control mode a time-averaged current caused by the voltmeter through the connection is less than 5% of the time-averaged current through the ionization electrode, and an ionization current amplifier having an input connected in a sequence with the ionization electrode, the flame region and the grounded burner, the sequence connected in parallel with the voltmeter.

2. The burner system as claimed in claim 1, further comprising a limiting resistor in the sequence preceding the ionization electrode or following the input of the ionization current amplifier, wherein the voltmeter comprises a series of resistors and a measuring unit which, during the voltage control mode, measures the AC voltage between two of the resistors, and has a measuring unit effective resistance, and wherein the voltage regulator has a voltage regulator effective resistance at an input thereof and a sum of the voltage regulator effective resistance and the measuring unit effective resistance is at least 10 times greater than a resistance of the limiting resistor.

3. The burner system as claimed in claim 2, wherein the voltmeter further comprises a rectifier in the series of resistors, and a filter smoothing the AC voltage measured between the resistors.

4. The burner system as claimed in claim 3, wherein the AC voltage source comprises a voltage generator; and a multiplier multiplying an output voltage of the voltage generator by a signal at an output of the voltage regulator.

5. The burner system as claimed in claim 4, wherein the AC voltage source further comprises a transformer connected on an output side in parallel with the sequence of the ionization electrode, the flame region, the grounded burner and the ionization current amplifier.

6. The burner system as claimed in claim 3, wherein the AC voltage source comprises a transformer connected on an output side in parallel with the sequence of the ionization electrode, the flame region, the grounded burner and the ionization current amplifier.

7. The burner system as claimed in claim 2, wherein the AC voltage source comprises a voltage generator; and a multiplier multiplying an output voltage of the voltage generator by a signal at an output of the voltage regulator.

8. The burner system as claimed in claim 7, wherein the AC voltage source further comprises a transformer connected on an output side in parallel with the sequence of the ionization electrode, the flame region, the grounded burner and the ionization current amplifier.

9. The burner system as claimed in claim 2, wherein the AC voltage source comprises a transformer connected on an output side in parallel with the sequence of the ionization electrode, the flame region, the grounded burner and the ionization current amplifier.

10. The burner system as claimed in claim 1, wherein the voltmeter comprises a series of resistors;

a measuring unit measuring the AC voltage between two of the resistors during the voltage control mode;

a rectifier; and a filter smoothing the AC voltage measured between the resistors.

11. The burner system as claimed in claim 10, wherein the AC voltage source comprises a voltage generator; and a multiplier multiplying an output voltage of the voltage generator by a signal at an output of the voltage regulator.

12. The burner system as claimed in claim 11, wherein the AC voltage source further comprises a transformer connected on an output side in parallel with the sequence of the ionization electrode, the flame region, the grounded burner and the ionization current amplifier.

13. The burner system as claimed in claim 10, wherein the AC voltage source comprises a transformer connected on an output side in parallel with the sequence of the ionization electrode, the flame region, the grounded burner and the ionization current amplifier.

14. The burner system as claimed in claim 1, wherein the AC voltage source comprises a voltage generator; and a multiplier multiplying an output voltage of the voltage generator by a signal at an output of the voltage regulator.

15. The burner system as claimed in claim 14, wherein the AC voltage source further comprises a transformer connected on an output side in parallel with the sequence of the ionization electrode, the flame region, the grounded burner and the ionization current amplifier.

16. The burner system as claimed in claim 1, wherein the AC voltage source comprises a transformer connected on an output side in parallel with the sequence of the ionization electrode, the flame region, the grounded burner and the ionization current amplifier.

* * * * *